US006311980B1

(12) United States Patent
Sovine et al.

(10) Patent No.: US 6,311,980 B1
(45) Date of Patent: Nov. 6, 2001

(54) PROJECTILE RETRIEVAL SYSTEM

(75) Inventors: H. Addison Sovine; Kyle Bateman, both of Provo, UT (US)

(73) Assignee: Action Target, Inc., Provo, UT (US)

( * ) Notice: Subject to any disclaimer, the term of this patent is extended or adjusted under 35 U.S.C. 154(b) by 0 days.

(21) Appl. No.: 09/406,344

(22) Filed: Sep. 28, 1999

(51) Int. Cl.[7] ..... F41J 1/12
(52) U.S. Cl. ..... 273/410
(58) Field of Search ..... 473/168–170, 473/166; 273/404, 410, 394, 397

(56) References Cited

U.S. PATENT DOCUMENTS 3,567,223 * 3/1971 Gentiluomo ..... 473/166
4,272,078 * 6/1981 Vinette ..... 473/166
4,728,109 * 3/1988 Simonetti ..... 273/410
4,786,059 * 11/1988 Barimi ..... 273/404
4,919,437 * 4/1990 Salabe et al. ..... 273/410
5,738,593 * 4/1998 Coury et al. ..... 473/166
5,811,718 * 9/1998 Bateman ..... 273/404
5,848,794 * 12/1998 Wojcinski et al. ..... 273/404

* cited by examiner

*Primary Examiner*—Mark S. Graham
(74) *Attorney, Agent, or Firm*—Morriss, Bateman O'Bryant & Compagni, P.C.

(57) ABSTRACT

A projectile retrieval system includes one or more valves disposed to selectively release projectiles from a bullet stop and containment system. The valves are in pneumatic communication with a tube which utilized a negative air pressure generated by a vacuum to move the projectiles from the valves to a central container. The projectile retrieval system may also include a vacuum extension which enables the same system to retrieve bullets and casings, fragments and other debris on the range.

12 Claims, 7 Drawing Sheets

PROJECTILE RETRIEVAL SYSTEM

BACKGROUND OF THE INVENTION

1. Field of the Invention

The present invention relates to a system for retrieval of projectiles fired into a bullet stop and containment chamber. More particularly, the present invention relates to a system which removes bullets and bullet fragments from a series of containment chambers or an elongate chamber more conveniently and with less environmental exposure to the lead of the bullets.

2. State of the Art

In order to maintain their proficiency with various types of firearms, law enforcement officers and others routinely engage in target practice. For many years, target practice was conducted in environments in which there was little concern for recovering the bullets. Firing ranges commonly used a large mound of earth to decelerate the bullet after it had passed through the target. Such a system was generally safe, in that the dirt was effective in stopping the bullet and preventing injuries. (While the most common projectile at a firing range is a bullet, other projectiles, such as shot, can also be present. Thus, as used herein, projectiles includes bullets and vice versa.)

More recently, considerable concern has been raised about the lead contained in the bullet. Though the bullet fired in to the mound of dirt was safely contained from the point of being a moving projectile with a significant amount of inertial momentum, the lead in the bullet was free to escape into the environment. For example, when a mound containing a number of bullets became wet, lead could leach into surrounding soil and even the groundwater. When a range was used frequently, a considerable amount of lead could be released into the environment, thereby injuring wildlife and contaminating groundwater supplies.

Partially due to these concerns, firing ranges increasingly turned to the use of bullet containment chambers to capture fired bullets and fragments thereof. The bullets may be recycled or otherwise disposed of in accordance with environmental regulations.

Bullet containment chambers typically include an opening through which the bullet enters, a deceleration mechanism for slowing the bullet to a stop, and a container mechanism for holding the bullet until it is retrieved from the containment chamber.

One early bullet containment chamber is shown in U.S. Pat. No. 684,581 to Reichlin. The chamber had an opening over which a target was placed. The chamber sloped downwardly and inwardly to provide a rounded deceleration path. A container area was also provided at the bottom of the unit to collect bullets.

An alternate design is shown in U.S. Pat. No. 2,013,133 to Caswell. Rather than directing the bullet in a vertically circular path, the bullet stop of Caswell had the bullet travel initially in a generally horizontal circle as it decelerated. As the bullet slowed, it would drop to the bottom of the deceleration chamber where it could be retrieved.

Still another configuration of a bullet containment system is shown in U.S. Pat. No. 4,28,109 to Simonetti. The system uses a granular impact material to decelerate the projectile. The impact material is cycled to provide ongoing inflow of impact material, and the bullets can be removed and recycled, etc. Yet another configuration for containing bullets is shown in U.S. Pat. No. 5,255,924 to Copius. Similar to the traditional mound method, the patent teaches the use of a mound of sand to decelerate the projectiles. A drainage system is disposed under the sand to collect and process water which has come into contact with lead bullets and fragments contained within the same.

Still yet another bullet containment system is contained in U.S. Pat. No. 5,811,718 to Bateman. The containment system utilizes angled impact plates to decelerate bullets. Once the bullets had slowed sufficiently, they would fall into a canister mounted below the containment chamber.

Recognizing the environmental concerns raised by the lead dust which is created as the bullet is slowed to a stop, Bateman utilized a negative air system to draw air containing lead dust out of the containment chamber. The air could then be filtered to remove the lead dust prior to release into the atmosphere. The Bateman configuration is highly advantageous over most of the prior art configurations because lead dust is significantly reduced without the use of water or other carrying mediums. Those skilled in the art will appreciate that once water becomes contaminated with lead dust, disposal of the water can cause significant challenges - both environmentally and financially.

One drawback which most of the prior configurations have had is that someone must retrieve the bullets from the containment chamber. This can be particularly time consuming on a large range which may have over two hundred canisters for collecting bullets. Even if the person removing the bullets works quickly, it could take a couple of hours or more to empty each bullet containing canister. Additionally, even a small canister filled with lead can be relatively heavy.

Of even greater concern, however, is the careful handling which must be used by those collecting the bullets. In order to remove the bullets, the person retrieving the bullets must first put on a hazardous materials suit to protect the person from the lead dust associated with the bullets. The suit may be cumbersome and uncomfortable and may be extremely hot. Additionally, if collection is occurring while the range is in use, the range must be configured so that the person retrieving the bullets cannot be hit by ricochets, etc. Also, each impact of the bullet generates lead dust which can be released into the atmosphere. Thus, with many configurations it is unwise to attempt to retrieve bullets while the particular containment chamber is being used.

In addition to the collection of bullets which end up in the containment chambers, there is also a need to collect other by-products of the shooting. For example, after a cartridge is fired and the bullet projected into the containment chamber, the case is ejected from the gun. While each case will contain a small amount of lead, it is common to pick up the cases by hand or to use a conventional vacuum cleaning. Likewise, it is common for small lead fragments to be left on the initial impact surfaces which channel the bullet into the containment chambers. This debris is commonly cleaned either with a broom or with a conventional vacuum.

Thus, there is a need for an improved system for retrieving bullets from bullet containment chambers. Such a system should be easy to use and should minimize contact between the lead bullets and those charged with retrieval.

Additionally, the system should save time and decrease costs associated with bullet retrieval. Most desirably, the system should also provide a convenient manner for collecting cases and bullet fragments which do not make it into the container for proper disposal.

SUMMARY OF THE INVENTION

It is an object of the present invention to provide a bullet retrieval system which is inexpensive and easy to use.

It is another object of the present invention to limit the exposure of persons to lead dust and lead particles.

It is still another object of the present invention to provide a system which decreases the employee time necessary to retrieve bullets.

It is yet another object of the present invention to provide such a system which enables retrieval of bullets while bullets are being fired into the bullet containment chamber without risk to those retrieving the bullets and without risk of releasing lead dust into the atmosphere.

It is still yet another object of the present invention to minimize the need to use hazardous materials suits.

It is still yet another object of the present invention to facilitate clean-up of shooting related debris other than bullets.

The above and other objects of the invention are realized in specific illustrated embodiments of a bullet retrieval system including a plurality of control members which are placed in communication with bullet containment chambers. The control members are further disposed in communication with each other via a bullet transport mechanism which carries the bullets from the control members to a central processing location.

In accordance with one aspect of the invention, the control members are formed by a plurality of valves which are disposed in communication with the bullet containment chambers. The valves are remotely controlled to allow bullets from the bullet containment chambers to be released from the bullet containment chambers and into the transport mechanism. For example, a ball valve could be placed below each of the bullet containment chambers (or portions thereof). As projectiles are repeatedly fired into the chamber, they will accumulate above the valve. At some desired time interval or other period, the valve is then actuated to release the bullets from the chamber and into the transport mechanism.

The valves can be controlled in a variety of ways. In a simple system, the valves could be individually actuated (preferably from a remote location) to enable the operator of the firing range to empty containment chambers, or portions thereof, which are receiving a large number of rounds. In more sophisticated systems, the valves could be sequentially actuated periodically to retrieve bullets contained in the containment chambers. Even more sophisticated systems could employ sensors adjacent the valves to automatically actuate each valve when a predetermined load of bullets and fragments have accumulated above the valve.

In accordance with another aspect of the invention, the transport mechanism includes a vacuum system with sufficient suction to draw bullets into a remote receptacle. The vacuum is preferably connected to each of the valves so as to draw all bullets, fragments, etc., to a central location. The bullets are then fed into a central container where they can be enclosed and transported for recycling. While handling of the central container still requires the use of a hazardous materials suit, the exposure to lead dust and other risks are decreased significantly.

The use of the vacuum system can also be varied. The vacuum could be maintained continuously or could be actuated with each valve to decrease energy consumption.

While other transport mechanisms are available, many fail to contain lead dust and some, such as water, create serious environmental and financial concerns regarding disposal. Thus, a negative air transport system is believed to be highly advantageous over other alternatives.

In accordance with still yet another aspect of the present invention, the transport mechanism can be used for clean-up of shooting related debris other than bullets which have entered a containment chamber. Preferably, the transport mechanism utilizes negative pressure to form a vacuum and a hose is provided so that the same vacuum can also be used to remove cases, bullet fragments and other shooting debris. Preferably, the transport mechanism with include an elongate flexible hose which enables the user to reach the opposing end of the shooting range. Also preferably included is a case canister which is configured to collect cases while encouraging most lead dust, etc., to continue to a subsequent containment mechanism to thereby substantially isolate the cases and the lead dust.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims. Furthermore, it should be appreciated that the components of the individual embodiments discussed may be selectively combined in accordance with the teachings of the present disclosure.

Figure 1:
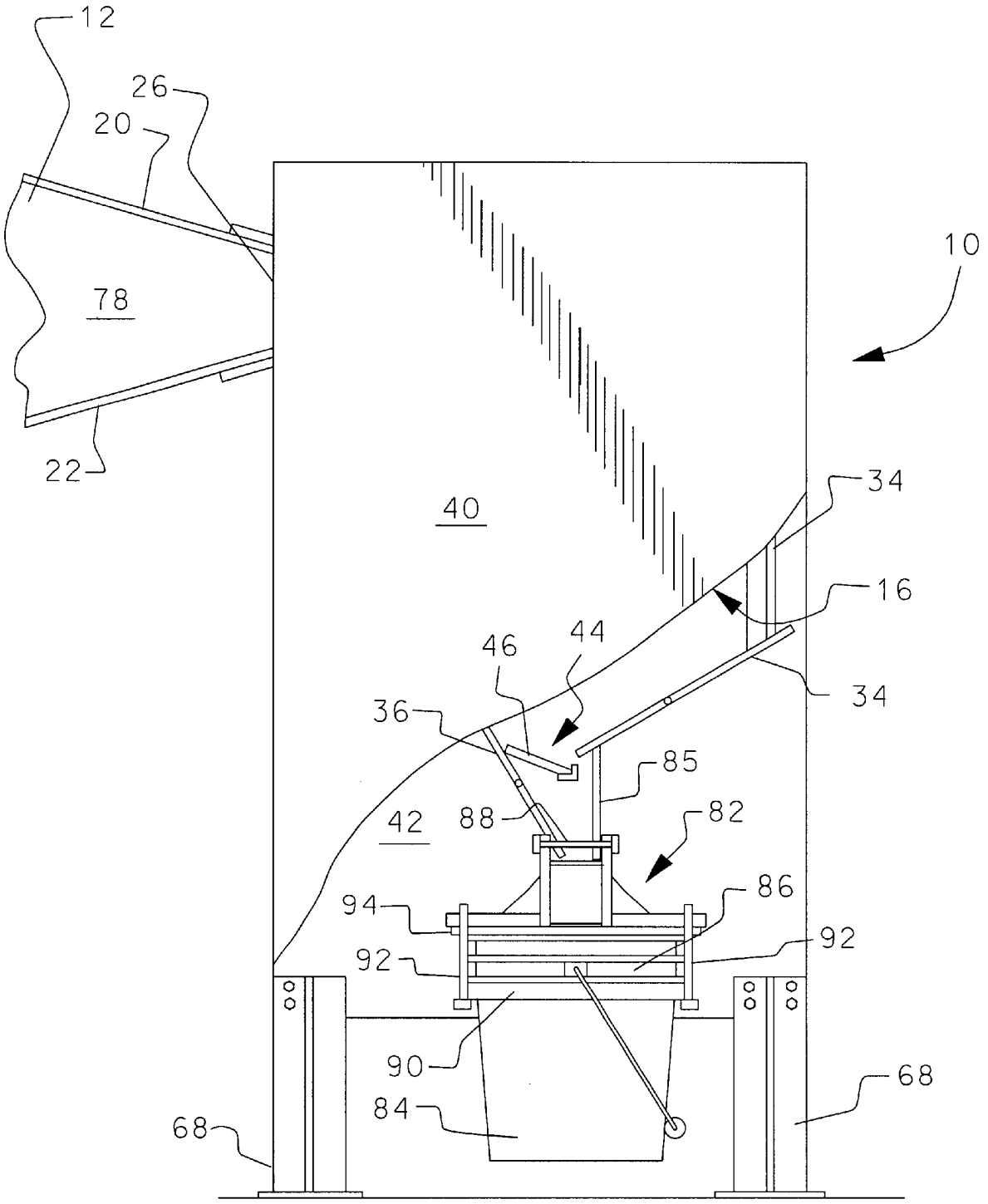
FIG. 1 (Prior Art)
FIG. 1 shows a partially cut-away side view of a bullet stop and containment chamber in accordance with the teachings of the prior art.

Referring to FIG. 1, there is shown a partially cut away view of a bullet stop and containment chamber in accordance with the principles of the prior art. The bullet stop and containment chamber, generally indicated at 10, includes a channel 12 which is configured for directing projectiles into a deceleration area formed by a chamber 16. The channel 12 is formed by an upper plate 20 and a lower plate 22 which are placed at complementary acute angles to the generally horizontal plane of travel of a projectile to direct the projectile into an opening 26 into the chamber 16.

After passing through the opening 26, the projectile impacts a plurality of impact plates, such as impact plate 34, impact plate 34" and impact plate 36. The impact plates 34, 34" and 36 decelerate the projectile and form an egress 44 from the chamber 16. A check plate 46 is also provided to ensure that a projectile does not leave the bullet containment chamber with a significant amount of inertial momentum.

Disposed below the bullet containment chamber 16 is an adapter 82 which is configured to receive a canister 84 for collecting projectiles which have been fired into the bullet stop and containment chamber 10. As the projectile decelerates, it falls through the adapter 82 and into the canister 84. The canister 84 is provided with an upper rim 86 which is held against the adapter 82 by bars which are held against the rim by bolts 92 which are attached to the lower edge 94 of the adapter.

As the bullet stop and containment chamber 10 is used, bullets and other projectiles collect in the canister 84. Eventually, the projectiles must be removed. On a heavily used shooting range, the canister 84 can fill up frequently. Emptying the canisters 84, however, raises several problems. First, because the canisters 84 are filled with lead and lead dust, the person emptying the canister must wear a hazardous materials suit to minimize the exposure to the lead.

Second, while the containment chamber 16 of FIG. 1 is specifically designed to prevent projectiles with significant inertial momentum from leaving the containment chamber 16, many configurations are not designed as safely. Thus, it is advisable to empty the canister when the bullet stop and containment chamber 10 is not being used.

Third, the time involved with emptying the containers can be significant. A large range may have twenty or thirty containment chambers, each having one or more canisters associated therewith. When the range is being used heavily, a worker can spend a considerable amount of time simply emptying containers. Thus, the man hours necessary to staff the range can be significant.

In accordance with the present invention, an improved bullet retrieval system is disclosed which alleviates the disadvantages of the prior art. The improved bullet retrieval system decreases the amount of staff time dedicated to bullet retrieval, decreases exposure of lead dust to the environment, and enables retrieval while the range is in use without risk to the staff.

Figure 2:
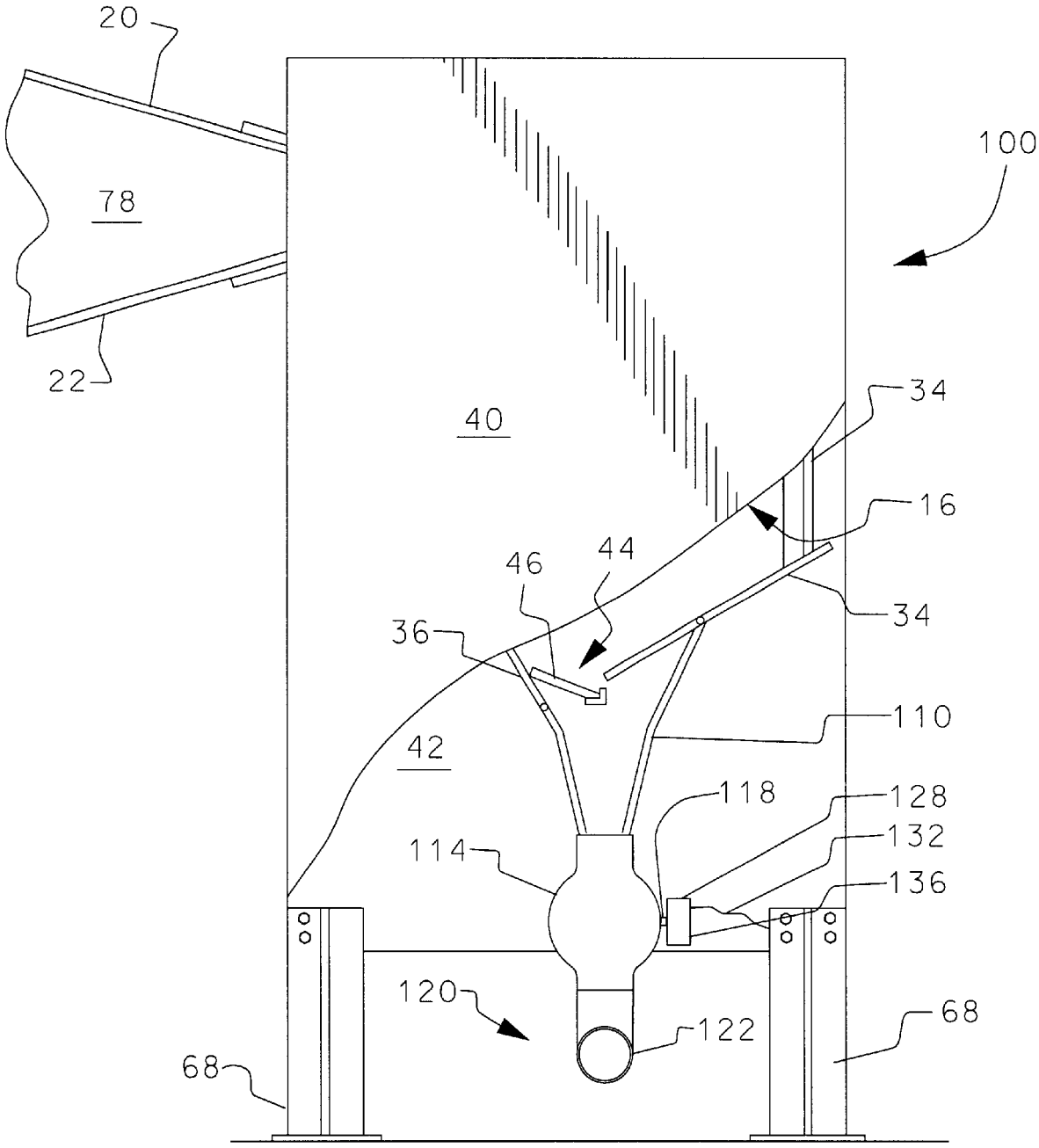
FIG. 2 shows a view of the containment chamber shown in FIG. 1, wherein the containment chamber has been modified in accordance with the teachings of the present invention.

Turning now to FIG. 2, there is shown side view of a containment chamber of FIG. 1 which has been modified to include a bullet retrieval system in accordance with the principles of the present invention. A substantial portion of the bullet stop and containment chamber 100 is the same as that discussed with respect to FIG. 1 and is, therefore, numbered accordingly. In light of the present disclosure, those skilled in the art will appreciate that a wide variety of bullet containment systems could be used with the advances of the present invention and the present disclosure should not be considered as limiting the present invention to the particular bullet stop and containment chamber 100 shown.

Disposed at the bottom of the containment chamber 16, in FIG. 2 is a hopper 110 which is configured to receive projectiles once they have passed by the check plate 46. The hopper 110 is disposed in communication with a valve 114 having a control mechanism 118. Preferably, the hopper 110 is generally funnel shaped, thereby directing the projectiles toward the valve 114.

Actuation of the control mechanism 118 moves the valve 114 between a first, closed position and a second, open position. In the first position, the valve 114 maintains the projectiles in the bullet stop and containment chamber 100. When the control mechanism 118 is actuated so that the valve 114 is opened, the projectiles are able to pass out of the containment chamber and through the valve. Typically only one valve 114 will be open at a time, as too many open valves would lessen the suction to the point where the projectiles will not be moved adequately.

Those skilled in the art will appreciate that the functioning of the control mechanism 118 will differ depending on what type of valve is present. For example, FIG. 2 shows a ball valve. Thus, the control mechanism 118 is a stem which rotates to thereby rotate the ball which serves as the valve member within the valve 114. If other types of valves were used, such as plunger valves—in which a plunger is pushed to allow flow through the valve, actuation of the valve would require different force applications.

The valve 114 is also disposed in communication with a transport mechanism, generally indicated at 120 for carrying bullets away from the valve. As shown in FIG. 2, the transport mechanism is formed by a transport tube 122 through which a negative pressure is drawn, thus forming a suction tube having a vacuum. As the valve 114 is rotated from the first, closed position to the second, open position, the vacuum draws the bullets and any associated lead dust through the valve and into the tube 122. The bullets and lead dust can then be carried to a central receptacle. Prior to release in the atmosphere, the air is filtered to remove the lead dust and other potentially harmful materials.

The control mechanism 118 could be manually activated. By eliminating the need for a person to remove the canisters 84 (FIG. 1), the risk of subjecting people to hazardous materials is decreased. Furthermore, the containment chambers 16 can be emptied more rapidly. Those skilled in the art will appreciate that the control mechanism 118 can be rotated from the first, closed position into the second, open position and back into the first, closed position much more rapidly than the cannister 84 can be removed, emptied and remounted under the containment chamber 16.

The drawback to manually actuating the valve 114 by the control mechanism 118 is that the bullet stop and containment chamber 100 must either not be used during actuation of the valve, or an employee is still placed behind the containment chamber 16 while rounds are being fired into the chamber. In the event the chamber were to fail and allow fragments to escape the chamber, the employee could be injured.

In accordance with the principles of the present invention, the control mechanism 118 is preferably actuated from a remote location. Thus, a valve actuator 128 is disposed adjacent the control mechanism 118. A control line 132 may be provided for actuating the actuator, or a receiver 136 could be used to allow for actuation responsive to radio controls. By "control line," it is understood that the line may communication either electrically or pneumatically to actuate the valve.

Actuation of the valve 114 by the actuator 128 will depend on the valve's configuration. The ball valve 114 shown in FIG. 2 is actuated by rotating the stem forming the control mechanism 118. Other valves, such a plunger valves, would be activated by advancing the plunger. After the valve 114 has been actuated for a desired period of time, the valve actuator 128 will return the valve to the first, closed position.

When the appropriate signal is sent to the valve actuator 128, the actuator rotates or otherwise moves the stem forming the control mechanism 118 so that the valve 114 is opened. With the valve 114 open, the bullets, etc., are drawn through the valve and into the transport mechanism in the form of a transport tube 122. Sufficient suction is drawn through the transport tube 122 to draw the projectile fragments through the pipe and into a central receptacle (not shown in FIG. 2). The airflow through the transport tube 122 which is necessary to move the projectiles can come either from the containment chamber or from a air make-up port (not shown) in the transport tube.

The actuator 128 is actuated to move the control mechanism 118 in the opposite direction to thereby close the valve 114. Those skilled in the art will appreciate that the length of time which the valve remains open may depend on the amount of negative pressure which is produced. Additionally, it is important the suction 122 tube be relatively air-tight. Leaks in the transport tube 122 will risk release of lead dust into the environment and will lessen the suction available for moving the projectiles.

By providing remote control of the valves 114, the operator of the firing range is provided with numerous options regarding bullet retrieval. For example, a manual remote control system can be used with the person overseeing the firing range simply actuating the valves 114 associated with those containment chambers which are being used, while not actuating the valves associated with chambers which are not being used.

In the alternative, the control mechanisms 118 could be disposed in communication with a computer which automatically cycles through the valves 114 at predetermined intervals. Because only a few seconds are needed to remove the projectiles from each chamber or portion thereof, an entire shooting range could be emptied of bullets within minutes—not the considerable time associated with manually emptying the canisters 82.

Figure 3:
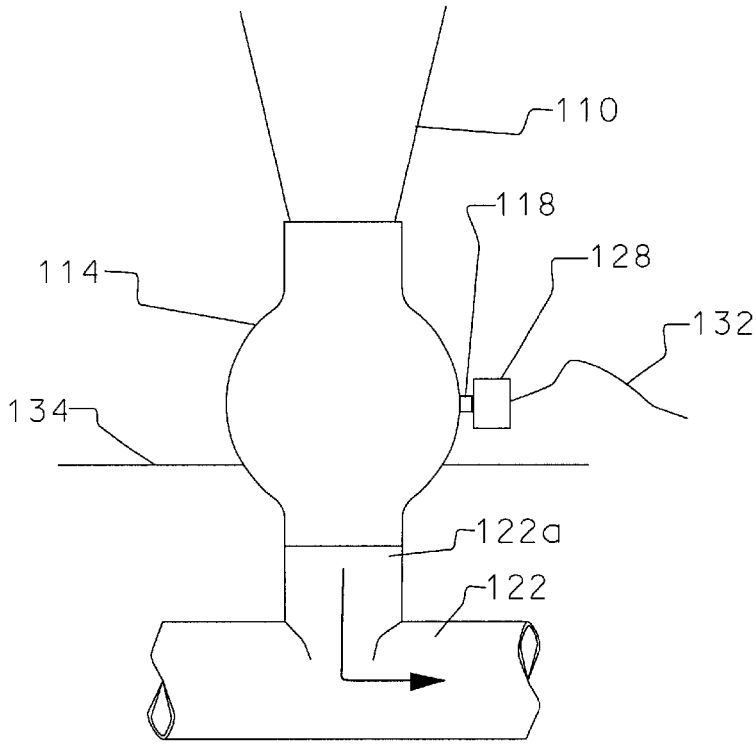
FIG. 3 shows a close-up view of a valve, valve controller and associated structure formed in accordance with the principles of the present invention.

FIG. 3 shows a close-up view of the valve 114, the valve actuator 128 and associated structures in accordance with the principles of the present invention. The valve 114 is preferably a ball valve, although other types of valves may be used. To actuate the valve 114, the actuator 128 must rotate the stem which forms the control mechanism 128 for the valve. As mentioned with respect to FIG. 2, actuation signals can be sent to the valve actuator 128 by a control line 132 or by radio signals to a receiver (not shown in FIG. 3).

Those skilled in the art will also appreciate that there are numerous mechanisms by which the valve actuator 128 could be supported. As shown in FIG. 3, the valved actuator 128 rests on a plate 134 attached to the housing of the bullet stop and containment chamber 100. With simple modifications, however, the actuator could rest on the ground, or could be mounted directly to the side of the valve 114.

Figure 4:
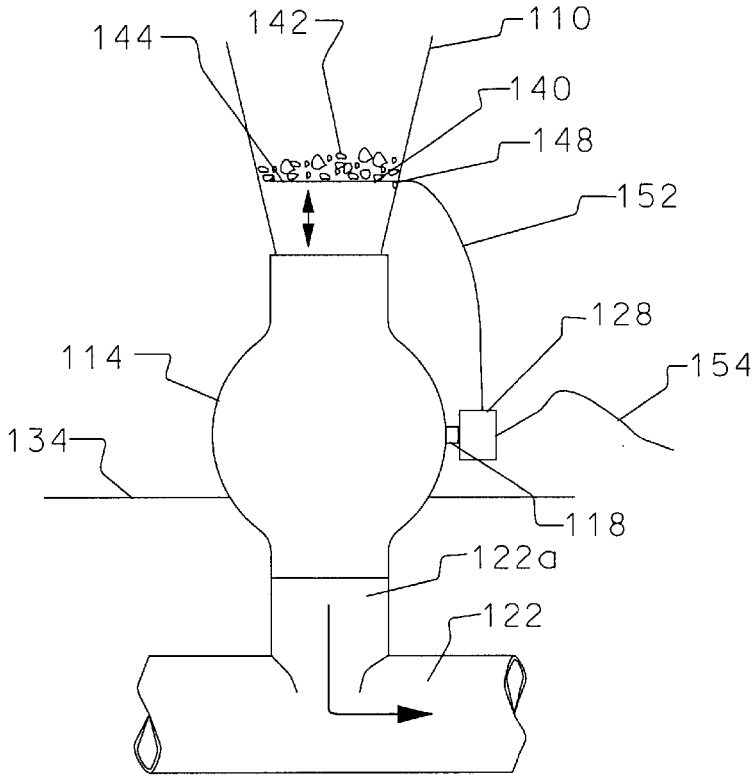
FIG. 4 shows a close-up view of a valve control mechanism in accordance with an alternate embodiment of the present invention.

Turning now to FIG. 4, there is shown a valve, valve actuator and related structure which is substantially the same as that shown in FIG. 3 and is thus numbered accordingly. Unlike the embodiment shown in FIG. 3, however, the valve actuator 128 is not configured to be responsive to a locationally remote signal generator, such as a computer or manual control. Rather, the mechanism for signaling the valve actuator 128 to move the valve 114 from the first, closed position into the second, open position, is a sensor 140 which is disposed adjacent the valve 114. The sensor 140 can be used to detect the presence of amount of projectiles 142 which need to be removed from the bullet stop and containment chamber 100. Thus, the valve 114 only needs to be actuated when there are projectiles which need to be removed.

As shown in FIG. 4, the sensor 140 is disposed in the hopper 110. As projectiles fall into the hopper 110, they land on a pivoting plate 144. Preferably, the pivoting plate is spring loaded into a horizontal position when no load is placed thereon. When a sufficient load of projectiles have landed on the plate 144, the plate gives way, allowing the projectiles to fall into the valve 114. The movement of the plate 144 causes a transducer 148 to send a signal over a sensor control line 152 to the valve actuator 128. The valve actuator 128, in turn, rotates the stem forming the control mechanism 118 to move the valve 114 into the second, open position.

Opening the valve 114 allows a vacuum present in the pipe 122 to reach the valve 114 via the connecting pipe 122*a*. While the projectiles 142 will typically fall through the valve 114, the vacuum assists in removing any lead dust or other debris which is not as dense as the projectiles. Once through the valve 114, the projectiles, lead dust, and any other debris are drawn through the pipe 122 and into a container associated with the vacuum (discussed below with respect to FIG. 5).

While the sensor 140 is shown as a valve which responds to the weight of the projectiles 142 to send the actuation signal to the valve actuator 128, other types of sensors could be used to indicate when the valve needs to actuated. For example, an optical sensor or some other electromagnetic sensor could be configured to send an actuation signal once a predetermined projectile load was present above the valve 114. In any such scenario, the sensor 140 allows the valve 114 to actuate only when necessary, thereby decreasing energy consumption and wear on the valve, etc. A control line 154 can also extend from the valve actuator 128 to the vacuum (not shown) to activate the vacuum and thereby provide suction for removal of the projectiles only when the valve 114 has been opened.

Figure 5:
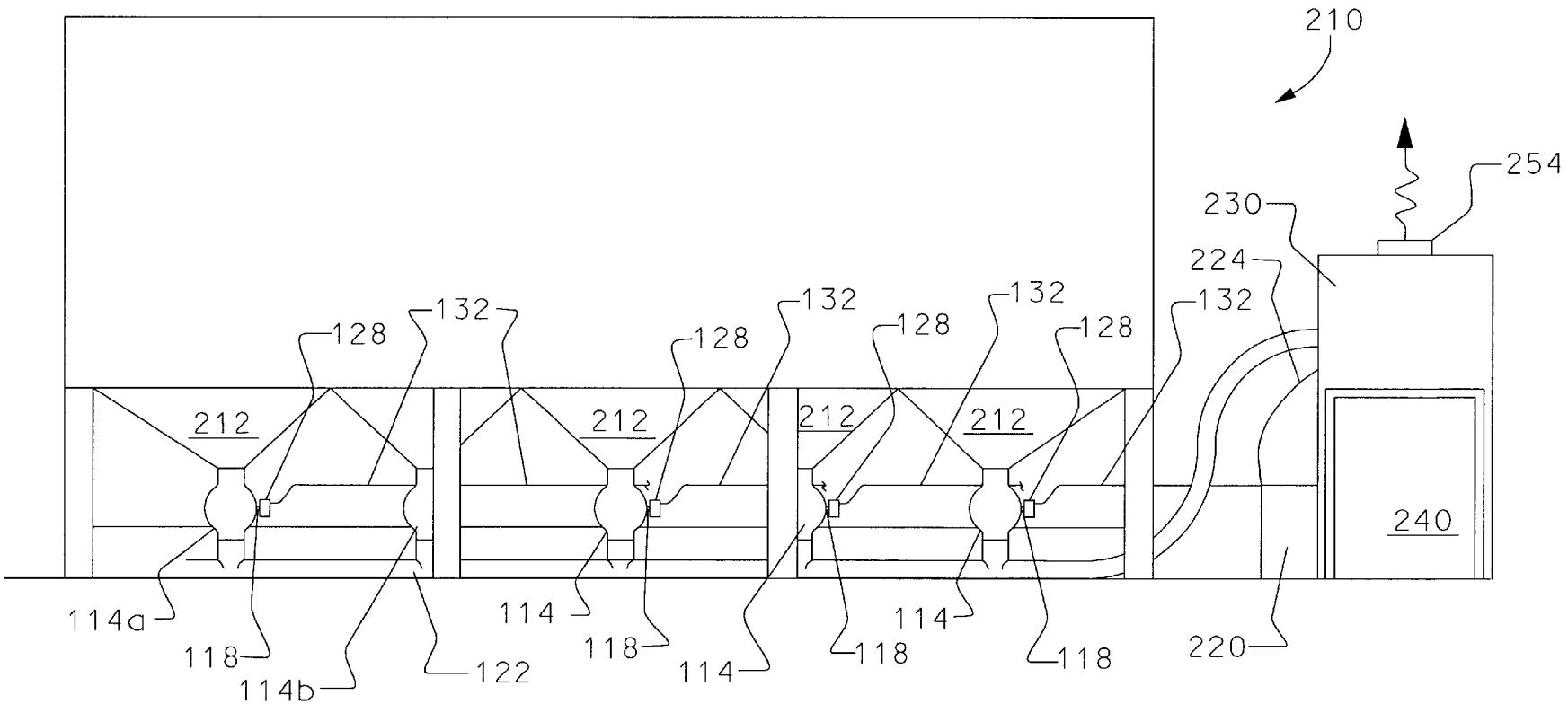
FIG. 5 shows a rear view of a bullet retrieval system in which a plurality of valves are used for a single bullet containment chamber.

FIG. 5 shows a rear view of a bullet retrieval system in accordance with the principles of the present invention. The bullet stop and containment chamber, generally indicated at 210, is formed of elongate metallic plates so as to form an elongate chamber. Such chambers are highly advantageous because they allow multiple users and do not require the shooter to aim directly at the back of the chamber.

Due to the length of the bullet stop and containment chamber 210, a single valve 114 would generally be inadequate to remove all of the projectiles. Thus, as shown in FIG. 5, the bullet stop and containment chamber 210 can be disposed in communication with a plurality of valves 114. To ensure a continuous travel path between the projectiles and the valves 114, hoppers 212 are disposed along the underside of the chamber 210. The most desirable spacing between the valves 114 will depend on a number of factors such as the angle necessary in the hoppers to promote sliding of projectiles to the valves, the amount of suction present and the size of the valves used.

As with the configurations shown in FIGS. 2–4, the projectiles will slide into a position adjacent one of the valves 114 principally due to gravity. Once the valve 114 is actuated, most of the projectiles will fall through the valve. Any projectiles which may have come to rest along the wall of the hopper 212 will be urged down as the valve 114 opens and suction is applied therethrough. Any lead dust or other materials in the hopper 212 will also be pulled downwardly.

Each of the valves 114 is moved between the first, closed position and the second, open position, by the actuator 128 rotating the stem forming the control mechanism 118. Of course, if other types of valves were used, the actuator would be selected to move the control mechanism for that valve. Such modifications will be obvious to those skilled in the art in light of the present disclosure. Each of the valve actuators 128 is controlled by a control line 132 which is connected to a remote control input mechanism in the form of a central processor 220. In accordance with the teachings of the present disclosure, those skilled in the art will appreciate that the processor may be a digital processor, a configuration which uses air logic or other pneumatics, or some electromechanical device which enables selective actuation.

While FIG. 5 shows a separate control line 132 for each valve actuator 128, those skilled in the art will appreciate that the valve actuators could be supplied with electronics which would allow them all to be disposed in a daisy chain wherein each is connected to the next valve actuator and information is relayed.

The central processor 220 is able to selectively control each of the valves 114, via the valve actuators 128, to provide bullet retrieval in any desired pattern. For example, the central processor may actuate the distal most valve 114 (relative to the vacuum source discussed below), followed by the second most distal valve 114*b*, etc. until each of the valves have been actuated. While the valves 114 are being actuated in whatever pattern is desired, the central processor 220 also uses a control line 224 to activate a vacuum 230 which develops negative pressure in the suction pipe 122 and draws the projectiles away from the valves 114.

The vacuum 230 must be of relatively high power to develop the suction necessary to move small pieces of lead. It is presently understood that a vacuum having approximately 15 hp is more than adequate to develop sufficient negative pressure for bullet retrieval.

As the air containing the bullets is drawn into the vacuum 230, the air and the bullets are separated. The bullets are released into a collection area, such as a container 240, dedicated room, etc., and the air is passed through a filter to remove lead dust prior to release into the atmosphere. Once the container 240 is filled, it must be sealed and prepared for transport to a recycling plant or other facility. Handling of the container 240 at this point typically requires the use of a hazardous materials suit. However, a 55 gallon container 240, may contain several days worth of retrieved bullets. This is in contrast to the present system of bullet retrieval in which the hazardous materials suit must be worn frequently to empty canisters containing bullets and other projectiles.

On a large shooting range, the vacuum 230 may be disposed in communication with twenty or thirty valves 114. If each valve 114 is opened and suction applied through the transport tube 122 for 15 to 20 seconds to allow retrieval of the bullets, 3 to 4 valves could be done per minute. Thus, a complete cycle through each portion of the bullet stop and containment chamber could be completed in 5 to 10 minutes, with less risk of lead dust escaping into the atmosphere, less inconvenience to the employees, and without any interruption in shooting. In contrast, the prior art method of retrieving the bullets could take an hour or more, could allow lead dust into the atmosphere, and could require those using the range to cease shooting while the canisters were being replaced.

Figure 6:
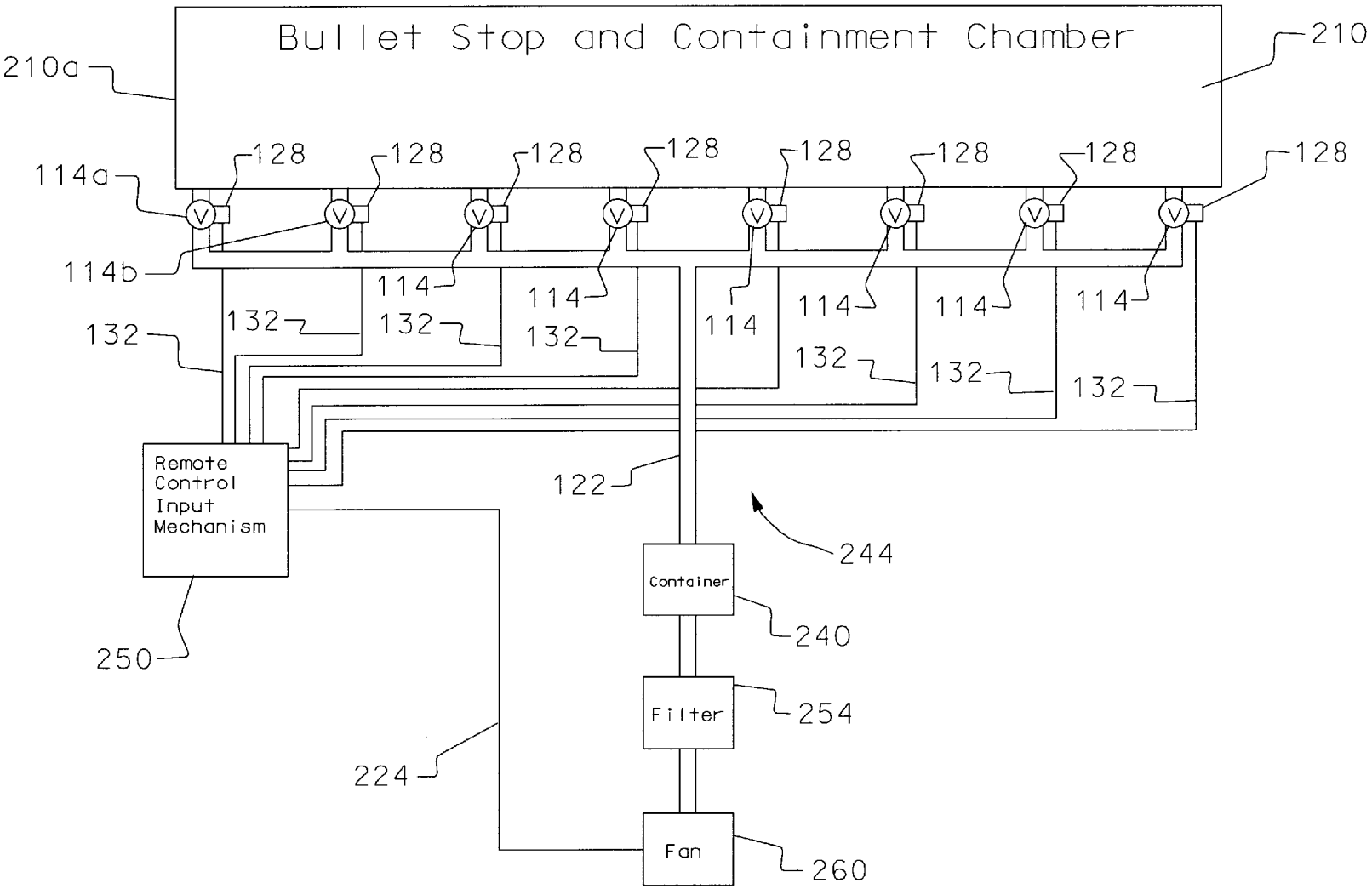
FIG. 6 shows a schematic representation of a bullet retrieval system of the present invention which utilizes a vacuum system to retrieve bullets from the containment chamber.

FIG. 6 shows a schematic representation of a bullet retrieval system of the present invention which utilizes negative pressure to retrieve bullets from a bullet stop and containment chamber 210. The bullet stop and containment chamber 210 is disposed in pneumatic communication with at least one valve 114 as discussed above. To minimize environmental exposure to lead, it is important that the connections between the valves 114, the bullet stop and containment chamber 210 and other structures of the vacuum system be relatively airtight.

The valves 114 are also disposed in pneumatic communication with the transport tube 122 which transports the retrieved bullets to a container 240. One reason for the schematic of FIG. 6 is to demonstrate the valves 114 and the vacuum system, generally indicated at 244, need not be in a linear array. Thus, the vacuum system is not limited by site geography or space limitations.

The valves 114 are moveable between a first, closed position and a second open position via valve actuators 128. The valve actuators 128 are typically controlled by a remote control input mechanism 250. The remote control input mechanism 250 can be a computer which is preprogrammed with cycles in which the valves 114 are actuated, such as the central processor 220 discussed with respect to FIG. 5. In another alternative, the remote control input device may simply be a series of levers or buttons to enable the operator of the range to empty which ever portions of the range he or she desires. Thus, if one end 210*a* of the range is being used repeatedly while the remainder is not being used, the operator may actuate valves 114*a* and 114*b*, and not actuate any of the other valves.

Once the bullets are in the transport tube 122, they are transported by suction created by a fan 260 and deposited in the container 240 where they are stored for recycling. The air which carried the bullets is passed through a filter 254 prior to being released into the environment.

While the bullet retrieval system of the present invention will generally add to the initial costs of a firing range, the increased efficiency will quickly compensate for the cost. By removing the need to manually retrieve bullet, considerable employee time is saved. Additionally, by maintaining the lead separate from atmosphere from the containment chamber to the storage container, the bullets and associated lead dust pose a smaller risk to the atmosphere.

In light of the present disclosure, those skilled in the art will appreciate numerous modifications which may be used. For example, one could used forced positive air pressure to move the projectiles instead of negative air pressure as set forth above. While using forced air would raise concerns about containing lead dust, it could be used by closing the valves prior to application of the air, along with maintaining air-tight transport tubes.

Figure 7A:
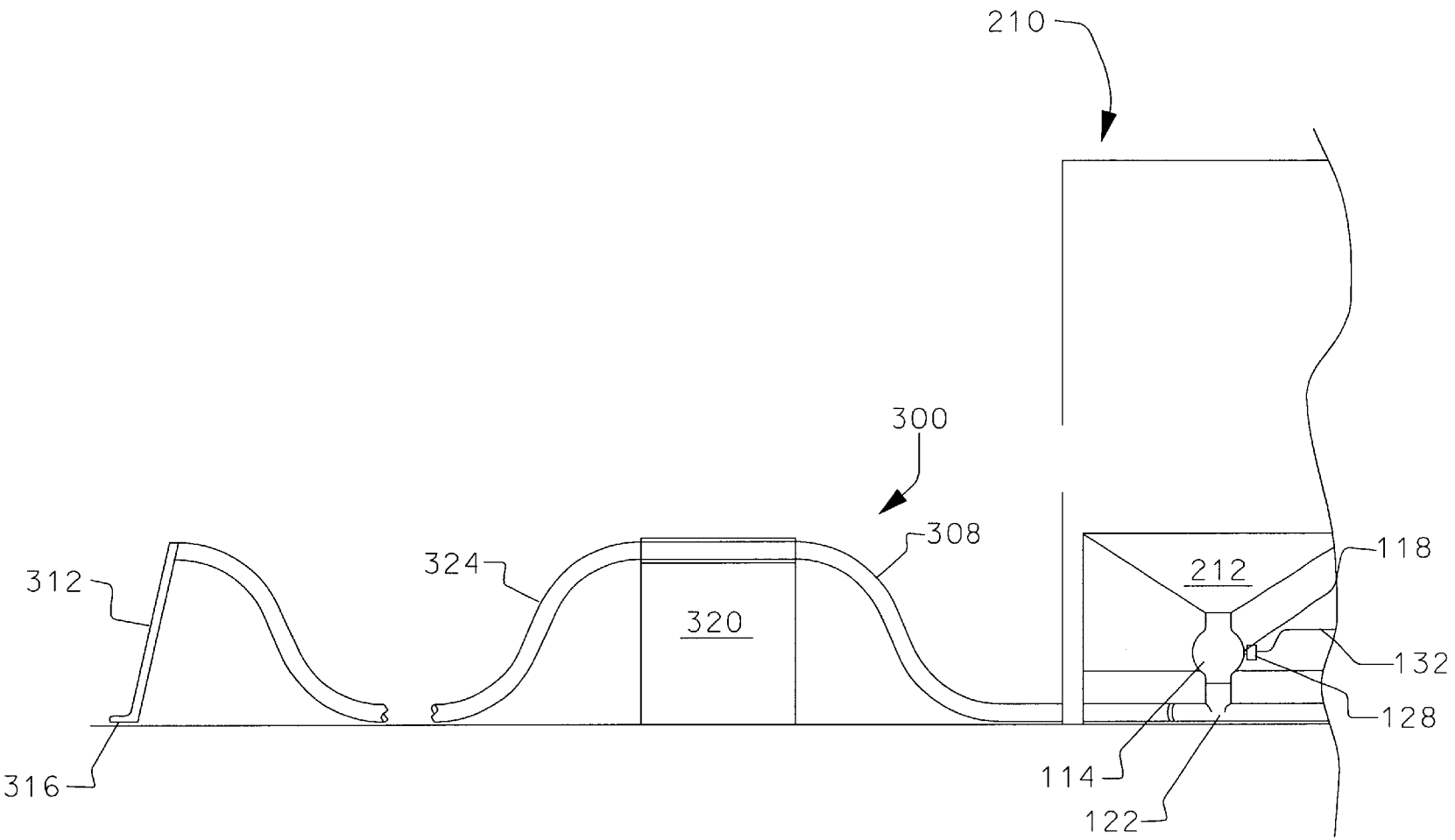
FIG. 7A shows a fragmented view of the bullet retrieval system any of the embodiments of FIGS. 1–6 with a vacuum extension attached thereto.

Turning now to FIG. 7A, there is shown a fragmented view of a bullet retrieval system, generally indicated at 210, and a vacuum extension, generally indicated at 300 in accordance with the principles of the present invention. Preferably, the transport tube 122, has a valve 304 disposed on the end thereof. The valve 304 allows an extension tube 308 to be attached to the transport tube 122 so that suction drawn through the transport tube causes air to be drawn through the extension tube.

The extension tube 308 may be flexible and form a vacuum hose which terminates with a vacuum head 312 with an opening 316 through which cartridge cases and bullet fragments can be drawn into the extension tube 308 and ultimately through the transport tube 122. Thus, the user is able to use the transport tube both to retrieve projectiles and to clean the shooting range.

Those skilled in the art will appreciate that it is common for people to sweep or vacuum the area with a conventional vacuum. In light of the lead dust which is present, sweeping or using a conventional vacuum simply increases the risk that the lead dust will become airborne and be inhaled by those at the shooting range. The present invention eliminates such concerns by directing the debris into a system which contains the lead dust.

Figure 7B:
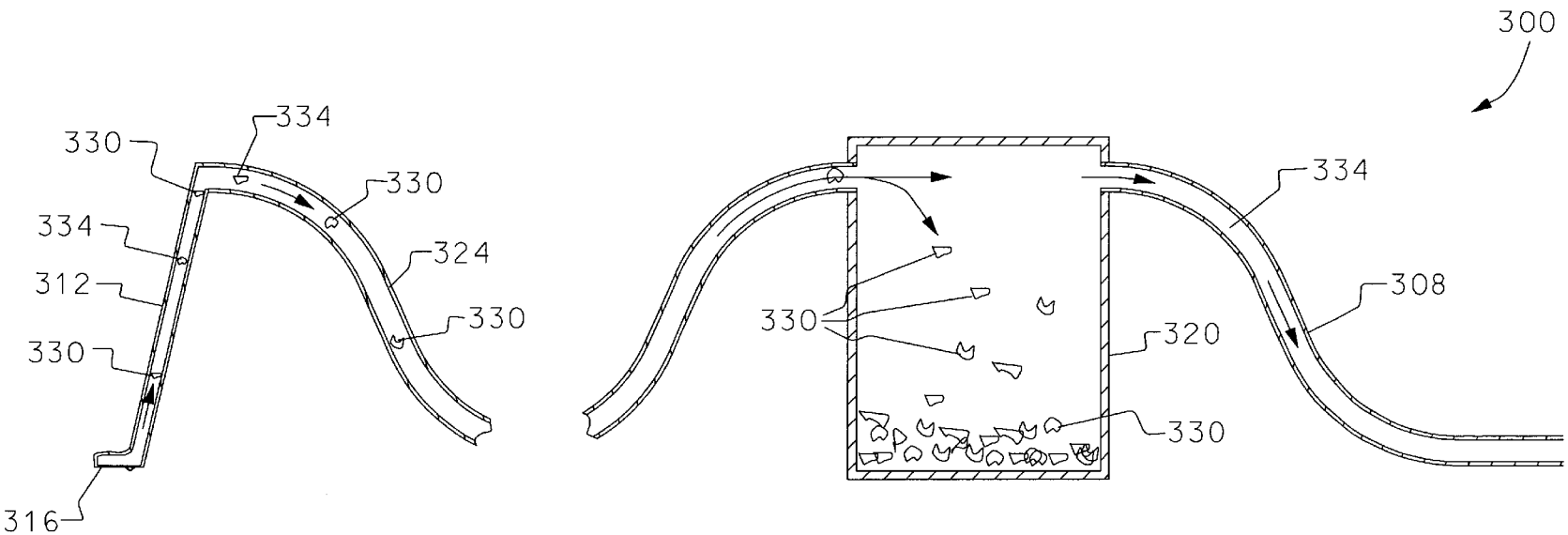
FIG. 7B shows a cross-sectional view of the vacuum extension shown in FIG. 7A.

While the extension tube 308 may be attached directly to the vacuum head 312, it is preferable to have a separating container 320 and an elongate flexible vacuum hose 324 disposed between the extension tube and the vacuum head. Bullet fragments, cases and other debris are drawn through the opening 316 in the vacuum head 312 and along the vacuum hose 324 by the suction supplied by the transport tube 122 as shown in FIG. 7B.

Cartridge cases 330 and lead dust 334 is drawn by suction into the opening 316 in the vacuum head 312 and along the vacuum hose 324. As the debris enters the separating container 320, the weight o f the cartridge cases 330 causes them to fall to the bottom of the container. The smaller bullet fragments, lead dust 334, and other fine debris continues to be carried through the extension tube 308 and through the transport tube 122. Ultimately the lead dust 334 either settles in the container containing the bullets (not shown in FIGS. 7A and *&b*), or is trapped by the filter (See FIG. 6).

The vacuum extension 300 is highly advantageous in that it enables a single system to retrieve bullets, clean up used cartridge cases, and clean the range of bullet fragments and other small debris while continuously isolating the user from exposure to the lead or any other debris which may be detrimental. Furthermore, the vacuum extension 300 can be used to automatically sort the cases which are primarily copper, from the lead dust and other debris. Once the separating container 320 and the bullet container 240 (FIG. 5) are sufficiently full, they can be transported for recycling.

Thus there is disclosed an improved bullet retrieval system which decreases environmental exposure to lead, increases the efficiency of bullet recovery, and which does not interfere with use of the range during bullet retrieval. Those skilled in the art will appreciate numerous modifications which can be made without departing from the scope and spirit of the present invention. The appended claims are intended to cover such modifications.

What is claimed is:

1. A projectile retrieval system comprising:

at least one projectile containment area for containing projectiles;

at least one control member disposed in pneumatic communication with projectile containment area, the control member having a first position wherein the control member maintains projectiles adjacent the projectile containment area and a second wherein the control member enables projectiles to move away from the projectile containment area, the control member comprising a valve and a sensor for actuating the valve in response to projectile load adjacent the valve; and a transport mechanism disposed in communication with the at least one control member, the transport mechanism being configured for carrying projectiles received from the at least one control member, the transport mechanism comprising a mechanism for generating airflow to move projectiles through the transport mechanism.

2. The projectile retrieval system of claim 1, further comprising a container disposed in communication with the transport mechanism for receiving projectiles from the transport mechanism.

3. The projectile retrieval system of claim 1, further comprising means for actuating the valve from a remote location.

4. The projectile load retrieval system of claim 1, wherein the transport mechanism comprises a vacuum and a transport tube for connecting the airflow to the control member.

5. The projectile load retrieval system of claim 1, wherein the at least one control member comprises a plurality of valves and wherein the transport means comprises a transport tube disposed in communication with each valve for carrying projectiles released through the valves to a central collection area.

6. A projectile retrieval system comprising:

a bullet deceleration chamber comprising a plurality of impact plates disposed to decelerate a bullet, the impact plates defining a bullet containment chamber having an egress;

a bullet transport mechanism disposed below the egress, the bullet transport mechanism comprising a vacuum and a tube for drawing bullets away from the bullet containment chamber; and a valve disposed adjacent the egress for selectively maintaining bullets in the bullet containment chamber and for selectively pneumatically isolating the bullet containment chamber from the bullet transport mechanism.

7. The projectile retrieval system according to claim 6, further comprising a sensor for determining an approximate quantity of bullets in the containment chamber.

8. The projectile retrieval system according to claim 7, further comprising means for actuating the valve responsive to the sensor.

9. The projectile retrieval system according to claim 7, wherein the plurality of impact plates form a plurality of bullet containment chambers, each bullet containment chamber having at least one valve, and wherein a plurality of valves are disposed in communication with a common bullet transport mechanism.

10. The projectile retrieval system of claim 7, further comprising an extension tube connectable to the bullet retrieval system for collecting bullets outside of the containment chamber.

11. The projectile retrieval system of claim 10, further comprising a bullet separating container disposed along the extension tube.

12. The projectile retrieval system of claim 7, further comprising a remote control switch for selectively actuating the valve.

* * * * *

UNITED STATES PATENT AND TRADEMARK OFFICE

CERTIFICATE OF CORRECTION

PATENT NO. : 6,311,980 B1
APPLICATION NO. : 09/406344
DATED : November 6, 2001
INVENTOR(S) : Sovine et al.

It is certified that error appears in the above-identified patent and that said Letters Patent is hereby corrected as shown below:

Column 4, Line 8 reads "... mechanism with include …"; should read -- ... mechanism includes ... --

Column 6, Line 57 reads "communication either ..."; should read -- communicate either... --

Column 7, Line 16 reads "... the suction 122 tube …"; should read -- ... the transport tube 122 ... --

Column 7, Line 35 reads "... the canisters 82."; should read -- ... the canister 84. --

Column 9, Line 26 reads "... the suction pipe 122"; should read -- ... the transport tube 122 --

Signed and Sealed this

Twenty-third Day of June, 2009

JOHN DOLL
*Acting Director of the United States Patent and Trademark Office*